US011147334B2

(12) United States Patent
Steck

(10) Patent No.: US 11,147,334 B2
(45) Date of Patent: Oct. 19, 2021

(54) APPARATUS AND METHOD FOR IMPROVING IMPACT PERFORMANCE OF HELMETS

(71) Applicant: William Steck, Stamford, CT (US)

(72) Inventor: William Steck, Stamford, CT (US)

( * ) Notice: Subject to any disclaimer, the term of this patent is extended or adjusted under 35 U.S.C. 154(b) by 423 days.

(21) Appl. No.: 15/725,346

(22) Filed: Oct. 5, 2017

(65) Prior Publication Data

US 2018/0098595 A1 Apr. 12, 2018

Related U.S. Application Data

(60) Provisional application No. 62/405,500, filed on Oct. 7, 2016, provisional application No. 62/504,944, filed on May 11, 2017.

(51) Int. Cl.
*A42B 3/12* (2006.01)
*A42C 2/00* (2006.01)

(52) U.S. Cl.
CPC ..... *A42B 3/127* (2013.01); *A42B 3/124* (2013.01); *A42C 2/00* (2013.01)

(58) Field of Classification Search
CPC ..... A42B 3/127; A42B 3/124; A42C 2/00
See application file for complete search history.

(56) References Cited

U.S. PATENT DOCUMENTS 3,011,602 A * 12/1961 Ensrud ..... E04C 2/32 428/180
3,018,015 A * 1/1962 Agriss ..... B65D 81/03 428/180
3,231,454 A * 1/1966 Williams ..... B65D 81/03 428/132
3,575,781 A * 4/1971 Pezely ..... B65D 81/03 428/180
3,609,764 A * 10/1971 Morgan ..... A42B 3/122 2/414
3,872,511 A * 3/1975 Nichols ..... A42B 3/121 2/413
3,999,220 A * 12/1976 Keltner ..... A42B 3/065 2/413
4,023,213 A * 5/1977 Rovani ..... A42B 3/121 2/413
4,586,200 A * 5/1986 Poon ..... A42B 3/122 2/413

(Continued)

*Primary Examiner* — Richale L Quinn
(74) *Attorney, Agent, or Firm* — Ohlandt, Greeley, Ruggiero & Perle, L.L.P.

(57) ABSTRACT

Disclosed are apparatuses and methods for improving the impact performance of helmets. The disclosed apparatuses and methods allow the head to move within the helmet but dissipate forces upon the head in a plurality of directions using compressible impact-dissipating elements. The compressible impact-dissipating elements are disposed on a base between the head and an outer shell of the helmet. The compressible impact-dissipating elements are attached to the base that is configured to adapt to the interior size/shape of the helmet with which they are used. The compressible impact-dissipating elements are compressible preferably at least 50% of their "short-axis" dimension, and are also preferably capable of movement in a plurality of directions by the use of appropriate attachment elements allowing for such movement.

18 Claims, 5 Drawing Sheets

(56) References Cited

U.S. PATENT DOCUMENTS 5,007,111 A * 4/1991 Adams ..... A41B 11/02 2/22
5,549,327 A * 8/1996 Rusche ..... B60R 21/04 280/751
6,969,548 B1 * 11/2005 Goldfine ..... B29C 44/1214 428/159
7,676,854 B2 * 3/2010 Berger ..... A42B 3/124 2/410
7,950,073 B2 * 5/2011 Ferrara ..... A42B 3/14 2/417
8,201,269 B2 * 6/2012 Maddux ..... A42B 3/127 2/424
8,713,716 B2 * 5/2014 Krueger ..... A41D 13/0002 2/412
8,844,066 B1 * 9/2014 Whitcomb ..... A42B 3/121 2/413
8,915,339 B2 * 12/2014 Kanous ..... E04F 15/18 188/377
8,955,169 B2 * 2/2015 Weber ..... A42B 3/125 2/411
9,113,672 B2 * 8/2015 Witcher ..... A42B 3/121
9,131,744 B2 * 9/2015 Erb ..... A42B 3/124
9,320,311 B2 * 4/2016 Szalkowski ..... A42B 3/12
9,370,214 B1 6/2016 Whitcomb
9,420,843 B2 * 8/2016 Cormier ..... A42B 3/127
9,439,468 B1 * 9/2016 Blagg ..... A42B 3/105
9,468,249 B2 * 10/2016 Fraser ..... B29C 69/00
9,516,910 B2 * 12/2016 Szalkowski ..... F41H 1/08
9,642,410 B2 * 5/2017 Grice ..... A42B 3/064
9,756,891 B1 * 9/2017 McGhie ..... A42B 3/121
10,258,100 B1 * 4/2019 Erb ..... A42B 3/124
2005/0246824 A1 * 11/2005 Berger ..... B29C 33/50 2/412
2008/0120764 A1 * 5/2008 Sajic ..... A41D 31/285 2/411
2011/0131695 A1 * 6/2011 Maddux ..... A42B 3/18 2/9
2013/0152287 A1 * 6/2013 Cormier ..... A42B 3/124 2/459
2014/0020158 A1 * 1/2014 Parsons ..... A42B 3/121 2/413

* cited by examiner

APPARATUS AND METHOD FOR IMPROVING IMPACT PERFORMANCE OF HELMETS

CROSS-REFERENCED APPLICATIONS

This application is related, and claims priority, to U.S. Provisional Application No. 62/405,500, filed on Oct. 7, 2016 and to U.S. Provisional Application No. 62/504,944, filed on May 11, 2017, that are incorporated herein in their entirety by reference thereto.

BACKGROUND

1. Field of the Disclosure

The present disclosure generally relates to apparatuses and methods for improving the impact performance of helmets. More particularly, the present disclosure relates to apparatuses and methods for providing improved impact performance for helmets that allow the head to move within the helmet but dissipate forces upon the head in a plurality of directions using compressible impact-dissipating elements between the head and an outer shell of the helmet. The apparatuses and methods of the present disclosure provide for protection of those portions of the human skull that are believed to be particularly vulnerable to injury from impact. The apparatuses and methods of the present disclosure also provide for more controlled deceleration of the movement of the head inside the helmet upon impact.

2. Background of the Disclosure

The purpose of protective helmets is to prevent head injury incurred during some event, usually a sporting or leisure event, such as football, ice hockey, horseback riding, skiing, lacrosse, baseball, cricket, sky diving and motorcycle riding, among others. Rigid helmets have been partially successful at preventing injuries. However, the recent epidemic of concussions and the increasing awareness of the cumulative problems associated with repeated head trauma have shown the limitations of protecting the head/brain from trauma with the current structure of protective helmets in all sports. Chronic traumatic encephalopathy (CTE) has attained notoriety recently. CTE is a degenerative disease found in people who have suffered repeated blows to the head. CTE is most commonly found in professional athletes participating in American football, rugby, ice hockey, boxing, professional wrestling, stunt performing, bull riding, rodeo riding, and other contact sports who have experienced repeated brain trauma, such as concussions and blows to the head that do not produce concussions. Less frequently occurring than concussions are those injuries and deaths caused by head trauma, some of which have occurred in leisure and in Olympic sports, such as luge and skiing. Indeed, the same limitations in effective protection could be claimed for all protective helmets, including construction helmets and military helmets.

The physics of head injury is focused on the distance over which deceleration occurs. The human brain is fragile, being composed of cells wrapped in membranes made of fluid fatty acids. Several trillion synapses in the brain are delicately poised in proximity to one another, without rigid and strong connections. These synapses are the functional means by which the brain operates. Shaking them disrupts them. The human nervous system has developed a host of strategies to encase the delicate neurons and their more delicate synapses in a protective cocoon of safety. First and foremost, the brain is floating in water (otherwise called the cerebral spinal fluid), creating a bath without rigid inflexible supports. Within that water, the brain is suspended in a delicate web of suspending fibers and membranes that keep the cerebral fluid from moving too quickly around the surface and allowing the brain to be gently suspended within the bony structure of the skull. The skull provides a rigid structure to contain the floating bath of cerebral fluid. Of note, the skull can be cracked and shattered as one strategy of dissipating force. This may lead to survival with subsequent healing. The skull is a unique bony structure around the brain, not seen anywhere else in the human body. The scalp provides an additional layer of safety. It is mobile and yields when struck, providing a few extra millimeters of deceleration distance. The scalp tears when stressed by direct blows, creating yet another mechanism of safety. The tearing creates large and dramatic scalp wounds in direct head trauma, but the brain underneath survives. Finally, the human skull is surrounded by hair, which provides another layer of cushioning.

The formula for deceleration is simple: $-\Delta$Velocity/Time=Deceleration (the decrease in velocity over time=deceleration). The negative change in velocity is divided by time. Rigid structures striking each other have a spike of deceleration within the first 0.00001 seconds. The more rigid and brittle the structure, the higher the G-force generated for a shorter fragment of time. Injury prevention is generally accomplished by increasing the distance and therefore time during which deceleration occurs. For example, in the case of automobiles, the effectiveness of airbags is a result of an increase in the distance of deceleration of the human torso before it strikes the steering wheel. Automobiles are also designed to crumple so that force is taken up by bending metal, collapsing frames, shattering fenders, stretching seatbelts all of which increase the distance and time over which the human body inside decelerates. Each of these strategies also complements the others to have a net effect of human survival, lowering the G forces from sufficient to break bones to simple sprains, strains and bruises.

Beginning in June 2018, the National Operating Committee on Standards for Athletic Equipment's (NOCSAE's) certification standards for new helmets will change to include the ability to compensate for rotational forces caused by angular hits. While this applies to new helmets only, it will be understood that older helmets are deficient. It has been established that in football angular hits are more common than linear hits, and they are more damaging than linear hits because they stretch nerve tissue to a greater degree. This is the conclusion reached by Dr. Cantu based on studies. Dr. Cantu is a vice president of NOCSAE, a clinical professor of neurosurgery at the Boston University School of Medicine, and co-founder of the Concussion Legacy Foundation. Rotational force (or torque, moment, or moment of force), just as a linear force is a push or a pull, can be thought of as a twist to an object. Mathematically, torque is defined as the cross product of the vector by which the force's application point is offset relative to the fixed suspension point (distance vector) and the force vector, which tends to produce rotational motion.

Protective helmets have, to date, failed to provide a suitable cocoon of safety against linear impacts or rotational impacts for the simple reason that they do not allow the head to move but, rather, restrain the head within the helmet while trying to provide impact protection by other means.

For example, U.S. Pat. No. 3,872,511 discloses an impact absorbing covering for protective headgear that includes a hard shell of one or two material thicknesses, and having on its interior surface for contact with the protective headgear a multitude of fluid chambers normally having direct flow communication with the atmosphere or with a sealed chamber, but which are hermetically sealed when the covering is impacted to afford means to absorb the impact. The disclosed structure requires a complex valve arrangement to dissipate the energy of impact. Moreover, the disclosed structure is added to the outside of an existing helmet, while the head is still restrained inside the helmet and therefore must move in concert with the helmet itself.

U.S. Pat. No. 3,999,220 discloses helmets, shoulder pads, thigh pads and other protective equipment that employ a cushioning fluid such as a layer of compressed air to protect both the wearer and an opposing player in contact sports. The helmet or other apparatus has outer and inner walls made of resilient material spaced apart to form an air chamber. A central plastic shield that is disposed between the resilient walls imparts shape and rigidity to the apparatus and has multiple perforations to equalize the air pressure throughout the chamber when the walls flex under impact. This apparatus is also complex in structure and the head is still held firmly in the interior of the helmet. Moreover, the disclosed apparatus suggests that the rigidity of the protective apparatus should be greater for older persons and professionals.

U.S. Pat. No. 4,586,200 discloses a protective crash helmet designed to increase the safety and comfort of a motorcycle rider. One of the protective layers inside the helmet includes inflatable air bubbles whose pressure and consequently size may vary when connected to an outside air pressure supply. This feature is said to allow a more precise fit to a rider's head, all of which are not the same shape. The protective crash helmet also has a ventilating system for cooling the interior of the crash helmet. An air inlet located on the front of the helmet with a valving door allows air inside the helmet into a passageway that is the space between the respective air bubbles. An air outlet located in the rear of the helmet allows the air to pass through the helmet thereby cooling the rider. This apparatus also requires the use of a valve system between the inflatable air bubbles.

U.S. Pat. No. 9,370,214 discloses a helmet having blunt force trauma protection that includes a state-of-the-art helmet and a replaceable impact layer. The replaceable impact layer preferably includes at least one gas cell layer, a removable attachment system and an outer layer of sheet material. The at least one gas cell layer includes a plurality of gas cells created between two plastic sheets. Each cell will burst upon a pre-determined impact. The plurality of cells has a hexagon shape, but other shapes may also be used, such as round or square. The removable attachment system used is hook and loop fasteners (i.e., Velcro®), but other suitable removable attachment systems are said to be possible. At least one first pad of hook and loop fasteners is attached to an exterior surface of a prior art helmet and at least one second pad of hook and loop fasteners is attached to a bottom surface of the replaceable impact layer. The disclosed apparatus requires that the protective system of gas cells bursts upon impact, which obviously is of little use in leisure or professional sports where replacing the protective system after each impact renders the protective system essentially useless.

While the above examples of impact dispersion and protection may have some benefits, each of the foregoing has several drawbacks. For example, all are relatively complex in design and structure and all hold the head firmly in place within the protective helmet thereby still allowing for the impact to be ultimately directly transmitted to the skull. In addition, each of the foregoing seeks to reduce impact effects arising from direct impact, and none of the foregoing appears to consider possible lateral or angular movement of the head inside the helmet as a source of trauma, nor of any way to minimize that source of trauma.

It is, therefore, an object of the present disclosure to provide a protective apparatus for a head in helmets that is simple in design.

It is also an object of the present disclosure to provide a protective apparatus for a head in helmets that allows the head to move inside the helmet yet dissipate the force of impact.

It is also an object of the present disclosure to provide a protective apparatus for a head in helmets that absorbs impact in every direction that the head may travel inside the helmet.

These and other objects of the present disclosure will be apparent to those of skill in the art based upon the following detailed description and in the Figures showing preferred embodiments of the present disclosure.

In one embodiment, the present disclosure provides an apparatus for providing impact performance to a helmet, the apparatus comprising: a plurality of compressible impact-dissipating elements; a base adapted to accept the plurality of compressible impact-dissipating elements disposed thereon, wherein the base is configured to be connected to an interior surface of the helmet, wherein the compressible impact-dissipating elements are attached to the base so as to allow movement of the plurality of compressible impact-dissipating elements in a plurality of directions, and wherein the plurality of compressible impact-dissipating elements are sized and configured to contact a wearer's head when the helmet is worn; and at least one attachment element for removeably attaching a side of the base opposite the compressible impact-dissipating elements to the interior surface of the helmet. The base is generally made from a relatively thin sheet of thermoplastic material that is flexible and/or can be formed to configure to the inside dimensions of the helmet. By way of example, the base can be from about 1/32 inch to about 1/4 inch thick. The compressible impact-dissipating elements may be attached to the base using any mechanism, including for example an attachment that passes through, preferably, each compressible impact-dissipating element and attaches to the base. Such an attachment may preferably pass through a diameter of the compressible impact-dissipating element substantially parallel to the base or, also preferably may pass through a diameter of the compressible impact-dissipating element substantially perpendicular to the base. An alternative attachment mechanism may be an adhesive. If an adhesive is used, it is preferable to provide each compressible impact-dissipating element with a flattened surface area and the base with complementary flattened surface areas to provide a contact surface for each compressible impact-dissipating element with the base. It has been found that for spherical compressible impact-dissipating elements having a diameter of about 1", a flattened surface area of from about 1/4" to about 1/2" may provide a satisfactory surface area for a desirable combination of adhesion and movement, with a preferred flattened surface area of about 3/8". For those embodiments where the compressible impact-dissipating elements have a dimension of a "long axis" and a dimension of a "short axis" (see, e.g., FIGS. 3-5), the dimension of the flattened surface area may be adjusted accordingly.

An alternative embodiment of the present disclosure provides an apparatus for providing impact performance to a helmet where the base comprises two inner shells, one for the left side of the helmet and one for the right side of the helmet. The plurality of compressible impact-dissipating elements can be affixed to each inner shell using any of the attachment mechanisms discussed above. Once assembled, each of the two inner shells are affixed to the inside of the helmet with any attachment device/element of choice such as, for example, Velcro®, snaps, hot melt glues, zippers and like connection devices/elements known to those of skill in the art. Velcro® is the preferred connection element.

Another alternative embodiment of the present disclosure provides an apparatus for providing impact performance to a helmet where there is no base. Rather, the plurality of compressible impact-dissipating elements can be affixed directly to the interior surface of the helmet. In this embodiment, the preferred compressible impact-dissipating elements will be either the spherical shape or those having a dimension of a "long axis" and a dimension of a "short axis", as described above, having a flattened surface area and will be affixed to the inside of the helmet with high strength adhesive that is compatible with the helmet materials being used. Preferably, the adhesive will be quick-set to make assembly practical.

Of the above two alternate embodiments, that using two "half shells" is preferred for several practical reasons. First, it is believed to be much easier to affix the plurality of compressible impact-dissipating elements to a "half shell" rather than a "full shell" or directly to the inside of the helmet. Secondly, for direct attachment to the helmet, an adhesive that works well, i.e., is compatible, with both the plurality of compressible impact-dissipating elements and the helmet shell is required. Selecting such an adhesive, having in addition the quick-set requirement, may be difficult to achieve since the plurality of compressible impact-dissipating elements are thermoplastic and have certain characteristics, while the outer shell is usually made of a high strength and high impact resistance material, such as polycarbonate having other, different characteristics. On the other hand, using the "half shell" embodiment, a plastic material can be chosen for the "half shells" that has the correct combination of strength and adhesive compatibility with the plurality of compressible impact-dissipating elements since it is adhered to the inside of the helmet by an attachment device/element that can be selected independent of compatibility with both the "half shell" and helmet materials.

Having considered the anatomy/structure that is known about the human skull, the present inventor believes that the protection of two portions of the human skull, the pterions and the anterior fontanelle require special attention. The pterions are an area about 1.25"×1.25" in size located in the region of each temple. This is known to be the thinnest and weakest part of the skull. It is a region where multiple bones join in the early years of life. The meningeal artery is located immediately underneath this area. The anterior fontanelle is an area about 1.6"×1.0" in size where the frontal skull bone and the two parietal skull bones comes together. Roughly speaking, it is located near the top center of the skull. Unlike other fontanelles the anterior fontanelle does not become completely ossified until people are generally in their late twenties or later. As would be appreciated, these ages are "late" in athletic careers, such as football players. In addition, it is known that sometimes the anterior fontanelle never ossifies. For this reason, the area is soft, and can dent inwards. It is not clear how soft the anterior fontanelle might be, since that would only be ascertainable on an individual by individual basis, or what happens to the brain when the anterior fontanelle is dented in.

To protect these areas more completely, the present inventor has proceeded in a direction that may seem counterintuitive. Specifically, the perimeters of the compressible impact-dissipating elements in an area of approximately 2" by 2" is left open to surround the pterions and the anterior fontanelle and form an open protective bridge over them. In other words, the space covering the pterions and the anterior fontanelle will be empty space, i.e., no compressible impact-dissipating elements between the helmet shell and the wearers' skull. This configuration allows stronger areas of the skull structure to impact the compressible impact-dissipating elements, yet allow less direct pressure/impact to be imparted to the pterions and the anterior fontanelle. Ventilation holes may preferably be drilled through the helmet in the vacant spaces surrounding the pterions and anterior fontanelle. Alternatively, the pterions and the anterior fontanelle could be protected by using donut shaped padding to bridge those areas, with the remainder of the "half-shells" having the compressible impact-dissipating elements attached thereto.

In addition, the compressible impact-dissipating elements may preferably be spaced to accommodate the ear openings. Helmet ventilation may be provided by a plurality of holes in the "half shells" that are matched to corresponding holes in the helmet. The holes may be located between places on the "half-shells" that are marked for adhering each of the plurality of compressible impact-dissipating elements. In addition to providing ventilation, the holes may be employed to provide a means for proper alignment of the inner "half-shells" to the helmet. For example, three dowels that are the diameter of the ventilation holes may be inserted into holes in the helmet to properly align the "half-shells" for coupling with the helmet inner surface. To ensure that the correct holes are being used for alignment, the alignment holes and the dowels may be of a slightly larger diameter than other ventilation holes. The attachment mechanism(s) for affixing the shells to the helmet are aligned in the same manner.

To adjust for different head sizes, the inner helmet thickness can be changed. For example, changing helmet size from 7¼ to 7½ can be accomplished by changing the thickness of each "half-shell" to decrease the total inside diameter of the "half-shells" by ⅛". Helmet sizes could also be changed by using thinner "half-shells" and making up the difference by putting spacers between the shells. By combining both methods many sizes can be made available without the cost of changing the size of the outer shell. Typically, the "half-shell" material will be about half as thick as the helmet material, for example about 1/10" for the "half-shell" versus 2/10" for the helmet material. One possible method of fabricating a complete helmet having the compressible impact-dissipating elements according to the present disclosure is envisioned as follows. The largest helmet size (presumably extra-large) can be matched by "half-shells" that have an outer-radius-of-curvature matched to the inner-radius-of-curvature of the helmet. Once the compressible impact-dissipating elements are attached to the two "half-shells", these can be adhered directly to the helmet. To make smaller sizes, it is conceived that "half-shells" with a smaller radius-of-curvature can be used. In this instance spacers may be disposed between the "half-shells" and the helmet to compensate for the smaller radius-of-curvature. The spacer may be attached to the "half-shells". Thereafter, adhesive may be placed on the exposed surfaces of the spacers, and the "half-shell"/spacer assembly can be attached to the inside of the helmet. The spacers should be small (a diameter size about equivalent to that of the size of a dime). It is also envisioned that the spacers should be pliant so they "match" or assume the curvature of the surfaces to which they are attached, and to adhere evenly. As an alternative attachment, Velcro® can be used to attach the "half-shells" to the helmet as noted above.

Preferably, the compressible impact-dissipating elements contact one another when disposed on the base. Also preferably, the compressible impact-dissipating elements are attached to the base to allow movement thereof in a plurality of directions, i.e., along any combination of X, Y and Z directions, i.e., laterally, longitudinally and/or vertically, and preferably along any radius of 360° from the center of the compressible impact-dissipating elements. In addition, the compressible impact-dissipating elements are preferably sized and configured to be minimally compressed when the helmet is placed on a wearer's head. Most preferably, the compressible impact-dissipating elements are spherical in shape. Also, in preferred embodiments the attachments holding the compressible impact-dissipating elements to the base are themselves flexible and/or stretchable to provide an added amount of movement of the impact-dissipating elements in the plurality of directions. The attachments holding the compressible impact-dissipating elements to the base allow the compressible impact-dissipating elements to be singularly replaced should one or more compressible impact-dissipating elements become damaged. Also preferably, the base is made of a thin flexible material such that the base may be easily inserted into and attached to the shape of a helmet. In addition, the base can be provided with at least one connection element for removeably attaching the base to the inside of a helmet. The at least one connection element for removably attaching the base to the inside of a helmet again can be any attachment elements of choice such as, for example, Velcro®, snaps, hot melt glues, zippers and like connection elements known to those of skill in the art.

In another embodiment, the present disclosure provides a method for providing impact performance to a helmet, the method comprising: providing a plurality of compressible impact-dissipating elements; providing a base adapted to accept the plurality of compressible impact-dissipating elements disposed thereon, wherein the base is configured to be connected to an interior surface of the helmet; attaching the compressible impact-dissipating elements to the base, wherein the compressible impact-dissipating elements are attached to the base to allow movement of the plurality of compressible impact-dissipating elements in a plurality of directions, and wherein the compressible impact-dissipating elements are sized and configured to contact a wearer's head when the helmet is worn; and removeably connecting the base to an interior surface of the helmet with the compressible impact-dissipating elements disposed away from the interior surface of the helmet.

Preferably, the compressible impact-dissipating elements contact one another when disposed on the base. Also preferably, the compressible impact-dissipating elements are attached to the base to allow movement thereof in a plurality of directions, i.e., along any combination of X, Y and Z directions, i.e., laterally, longitudinally and/or vertically, and preferably along any radius of 360° from the center of the compressible impact-dissipating elements. In addition, the compressible impact-dissipating elements are preferably sized and configured to be minimally compressed when the helmet is placed on a wearer's head. Most preferably, the compressible impact-dissipating elements are spherical in shape. Also, in preferred embodiments the attachments holding the compressible impact-dissipating elements to the base are themselves flexible and/or stretchable to provide an added amount of movement of the impact-dissipating elements in the plurality of directions. The attachments holding the compressible impact-dissipating elements to the base allow the compressible impact-dissipating elements to be singularly replaced should one or more compressible impact-dissipating elements become damaged. Also preferably, the base is made of a thin flexible material such that the base may be easily inserted into and attached to the shape of a helmet. In addition, the base is provided with at least one connection element for removeably attaching the base to the inside of a helmet. The at least one connection element for removably attaching the base to the inside of and helmet can be any attachment elements of choice such as, for example, Velcro®, snaps, hot melt glues, zippers and like connection elements known to those of skill in the art.

As used herein, the word "compressible" is intended to mean that the compressible impact-dissipating elements can be compressed along a diameter (when spherical) or short axis (when having "long" and "short" axes) thereof at least about 50% of the original dimension of the diameter or short axis, preferably at least about 75% of the original dimension the diameter or short axis, more preferably from about 90% to about 100% of the original dimension of the diameter or short axis, and most preferably 100% of the original dimension of the diameter or short axis. As used herein, the term "short axis" means the smaller dimension of a cross-section through the compressible impact-dissipating elements. For example, when the compressible impact-dissipating elements are spherical, "short axis" will be any diameter. On the other hand, when the compressible impact-dissipating elements are tubular or "football" shaped, the "short axis" will be that disposed across the largest section of the smaller dimension of the tubular or "football" shape. Also, it will be understood that 100% compressible means that opposing interior sides of compressible impact-dissipating elements located on the "short axis" meet each other when compressed.

Moreover, the compressible impact-dissipating elements should have little or no memory, such that the compressible impact-dissipating elements return to their original dimension after compression. This allows the compressible impact-dissipating elements to repeatedly absorb impact and be useful over the long term for impact dissipation. In addition, the compressible impact-dissipating elements should contact or nearly contact adjacent compressible impact-dissipating elements when attached to the base. This configuration allows for better impact dissipation and absorption in that, it is believed, impact can be dissipated not only by the compressibility of the compressible impact-dissipating elements directly by the head, but also by "communicating" and "sharing" impact dissipation with adjacent compressible impact-dissipating elements. Preferably, the compressible impact-dissipating elements are substantially spherical in shape, although other shapes can be used as shown in the accompanying Figures. When the compressible impact-dissipating elements are substantially spherical in shape, the diameter of the compressible impact-dissipating elements should range from about ½ inch to 1 inch, preferably from about ⅝ inch to ¾ inch and, more preferably, about ¾ inch. As will be appreciated, the diameter of the compressible impact-dissipating elements, when spherical, should allow the outer dimension of the helmet into which they are placed to be altered minimally from a standard size of the helmet. Also, when the compressible impact-dissipating elements are shaped other than spherical, the attachments thereof to the base may be varied accordingly, such as by using a plurality of attachments. Also, as noted above, when the compressible impact-dissipating elements are shaped other than spherical, the dimensions generally will comprise a "long axis" and a "short axis". In this case, the "long axis" of a compressible impact-dissipating element preferably should be such that it is substantially equal to a plurality of "short axes" of adjacent compressible impact-dissipating elements. For example, the "long axis" of a compressible impact-dissipating element may be ½ inches to 3 inches, while the "short axis" thereof may be ½ inch to 1 inch. The dimensions allow for better overall "alignment" of the compressible impact-dissipating elements into repeating "stacked" patterns (see, e.g., FIGS. 3, 4 and 5). The dimensions disclosed herein are of no particular import, keeping in mind that the compressible impact-dissipating elements should preferably have the compressibility described above and also preferably contact or nearly contact adjacent compressible impact-dissipating element(s). Of course, those skilled in the art will understand based on the present disclosure that a combination of shapes for the compressible impact-dissipating elements may be used in any particular embodiment.

Among the benefits of the apparatuses and methods for improving impact performance of helmets disclosed herein are that the skull and brain move more in concert with each other as impact is being dissipated. For example, the skull is not held rigidly or firmly in place in the helmet but is allowed to move as impact is dissipated by the compressible impact-dissipating elements. As such, the apparatuses and methods of the present disclosure will reduce movement of the brain inside the skull and cooperate with the cerebral fluid to lessen the trauma and effects of impact to the brain itself. Also, due to the compressible nature of the compressible impact-dissipating elements that are in direct contact with the head, the force of impact to the head is delayed and dispersed as the head is compressing the compressible impact-dissipating elements. In addition, due to the nature of the attachment of the compressible impact-dissipating elements to the base allowing for movement of the compressible impact-dissipating elements in a plurality of directions, impact can be absorbed in a plurality of directions as well. In other words, since an impact in, e.g., football, nearly always involves an impact in an angular direction, the impact to the head is angular in direction as well. It will be appreciated that the ability of the compressible impact-dissipating elements to move in a plurality of directions to absorb impact allows impact to be dissipated more completely and safely.

BRIEF DESCRIPTION OF THE DRAWINGS

Further features, advantages and details of the present disclosure will become apparent from the following description of the drawings in which like numbers denote like elements and in which.

DETAILED DESCRIPTION OF THE DISCLOSURE

Figure 1:
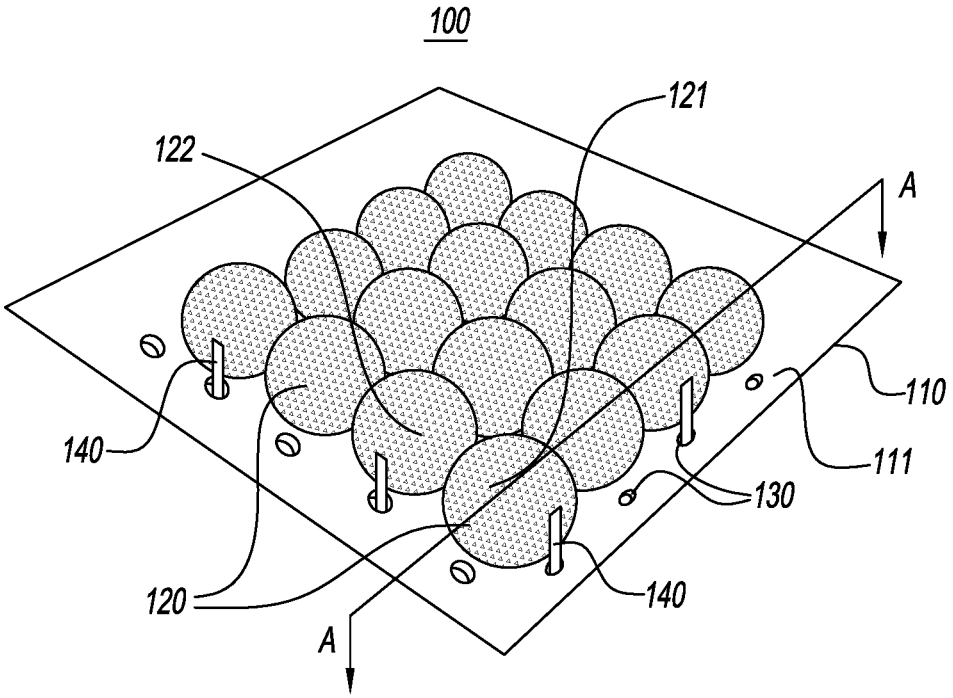
FIG. 1 is a schematically simplified perspective view of a preferred apparatus protective apparatus according to the present disclosure

FIG. 1 shows a simplified view of a preferred embodiment of an apparatus 100 according to the present disclosure. Apparatus 100 includes a base 110 and having disposed thereon a plurality of compressible impact-dissipating elements 120. As shown in FIG. 1, compressible impact-dissipating elements 120 are generally spherical in shape. Base 110 includes a plurality of attachment sites 130 sized and configured to receive attachment elements 140. In the embodiment shown in FIG. 1, attachment elements 140 are fiber-like elements and attachment sites 130 are holes through base 110. Given that compressible impact-dissipating elements 120 are spherical in shape, attachment sites 130 are evenly spaced apart in a "grid" configuration. As shown in FIG. 1, adjacent compressible impact-dissipating elements 120 are attached to base 110 using attachment elements 140 that are disposed through adjacent compressible impact-dissipating elements 120 in a "perpendicular" array. For example, attachment element 140 through compressible impact-dissipating element 121 is disposed perpendicularly to attachment element 140 disposed through compressible impact-dissipating element 122. This type of altering of attachment elements 140 allows for effective movement of compressible impact-dissipating elements 120, e.g. compressible impact-dissipating elements 121, 122 in a plurality of directions. Of course, attachment element 140 could be attached directly to upper surface 111 of base 110 using suitable attachment elements 140 and mating attachments (not shown in FIG. 1) on base 110. In this embodiment, attachment elements 140 and mating attachment elements (not shown) could be a snap-fit attachment, a screw and thread attachment, or similar type of attachment that those of skill in the art would understand. As shown in FIG. 1, base 110 is substantially planar in configuration. This configuration shown in FIG. 1, however, is merely for purposes of providing an understanding of the apparatus of the present disclosure. In practice, base 110 will, of course, be configured to fit in contact with the inside dimension of the helmet into which it is placed such that compressible impact-dissipating elements 120 are disposed toward the interior of the helmet and away from the exterior the helmet so as to contact a user's head. Also in practice, base 110, as mentioned above, will be made of a flexible material such that it can conform to the inside dimension of a helmet. Connection elements (not shown in FIG. 1) will be disposed on the side of base opposite compressible impact-dissipating elements 120 so that base 110 may be removably affixed to the interior surface of the helmet. Also as mentioned above, attachment elements 140 should themselves preferably be flexible or elastic in nature so as to better allow impact dissipation and movement of compressible impact-dissipating elements 120 in a plurality of directions.

Figure 2:
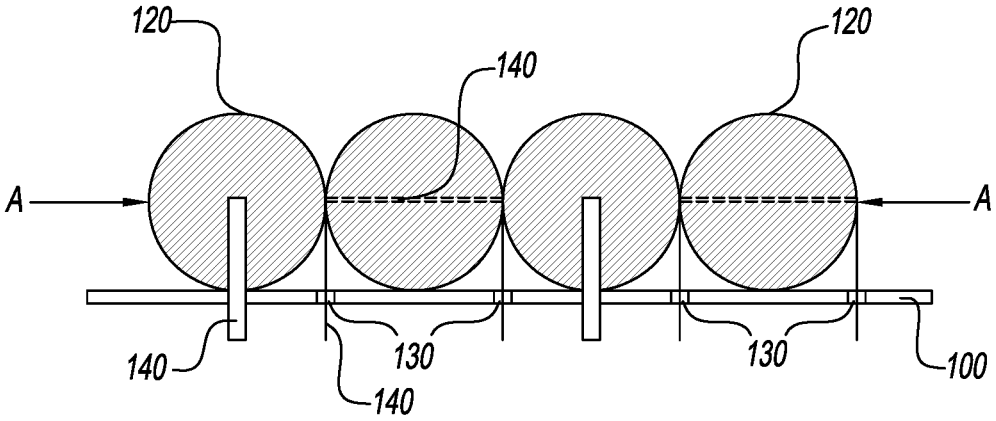
FIG. 2 is a side cross-sectional view of the protective apparatus of FIG. 1 along line "A"-"A".

FIG. 2 shows a cross-sectional view of base 110, compressible impact-dissipating elements 120, attachment sites 130 and attachment elements 140 through line "A"-A" of FIG. 1. As shown in FIG. 2, attachment elements 140 of the adjacent compressible impact-dissipating elements 120 are disposed in an alternating configuration, substantially perpendicular to one another.

Figure 3:
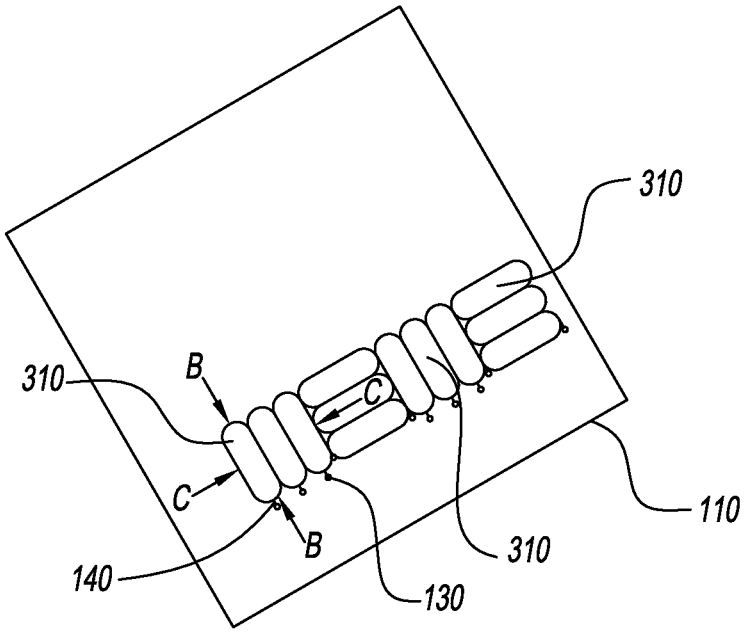
FIGS. 3-5 show alternative embodiments of the protective apparatus of the present disclosure.
Figure 4:
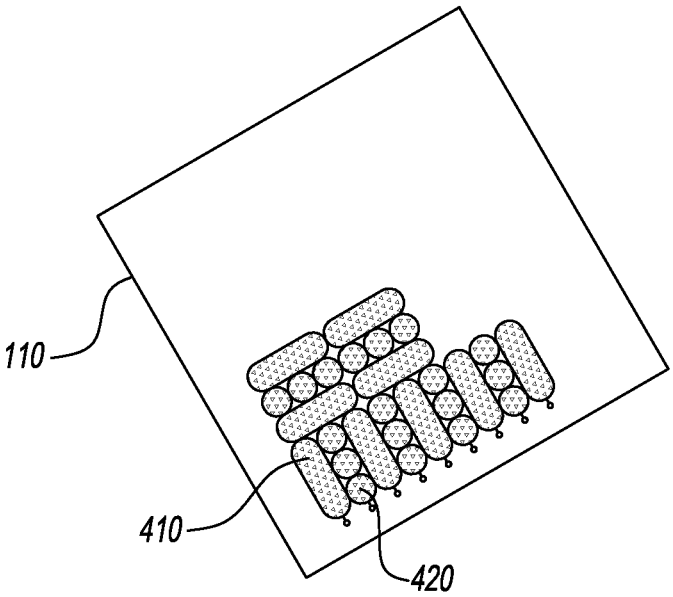
Figure 5:
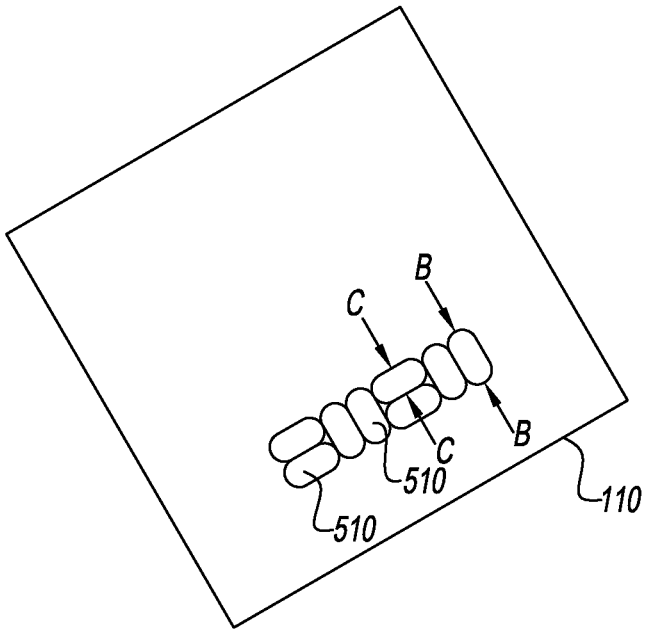

FIGS. 3-5 show alternative configurations of base 110, compressible impact-dissipating elements 310, attachment sites 130 and attachment elements 140. In FIG. 3, compressible impact-dissipating elements 310 have a dimension of "long axis" along line "B"-"B" that is approximately 3 times the dimension of "short axis" along line "C"-"C". For example, if the dimension of long axis "B"-"B" is 1.5 inches, then the dimension of short axis "C"-"C" is approximately 0.5 inches. This allows for a positioning of compressible impact-dissipating elements 310 in a 3×3 configuration, with three compressible impact-dissipating elements 310 placed in a first direction and three compressible impact-dissipating elements 310 placed in a second direction that is substantially perpendicular to the first direction. In FIG. 4, compressible impact-dissipating elements 410, similar to compressible impact-dissipating elements 310 in FIG. 3, have a dimension of "long axis" along line "B"-"B" that is approximately 3 times the dimension of "short axis" along line "C"-"C". Also in FIG. 4, compressible impact-dissipating elements 420 may be, for example, substantially spherical in dimension similar to compressible impact-dissipating elements 120 shown in FIG. 1. As shown in FIG. 4, the configuration of compressible impact-dissipating elements 410, 420 is such that is such that the "long axis" of compressible impact-dissipating elements 410 is approximately 3 times the cross-sectional dimension of compressible impact-dissipating elements 420. For example, if compressible dissipating elements 410 are 1.5 inches along the "long axis", and if compressible impact-dissipating elements 420 are spherical in dimension, compressible impact-dissipating elements 420 can have a diameter of a proximately 0.5 inches. This sizing and configuration allows for alternating rows of compressible impact-dissipating elements 410 being adjacent to rows of three compressible impact-dissipating elements 420. In FIG. 5, compressible impact-dissipating elements in 510 are shaped similar in principle to compressible impact-dissipating elements 300 in FIG. 3 and compressible impact-dissipating elements 410 in FIG. 4. For example, compressible impact-dissipating elements 510 have a dimension along "long axis" "B"-"B" that is approximately 2 times the dimension along "short axis" "C"-"C". Thus, if compressible dissipating impact elements 510 have a dimension of 1.5 inches along "long axis" "B"-"B", compressible impact-dissipating elements 510 have a dimension of 0.75 inches along "short axis" "C"-"C". Again, the sizing and configuration of compressible impact-dissipating elements 510 allows for two alternating rows of compressible impact-dissipating elements disposed in approximately 90° orientation to adjacent rows of compressible impact-dissipating elements 510.

Figure 6:
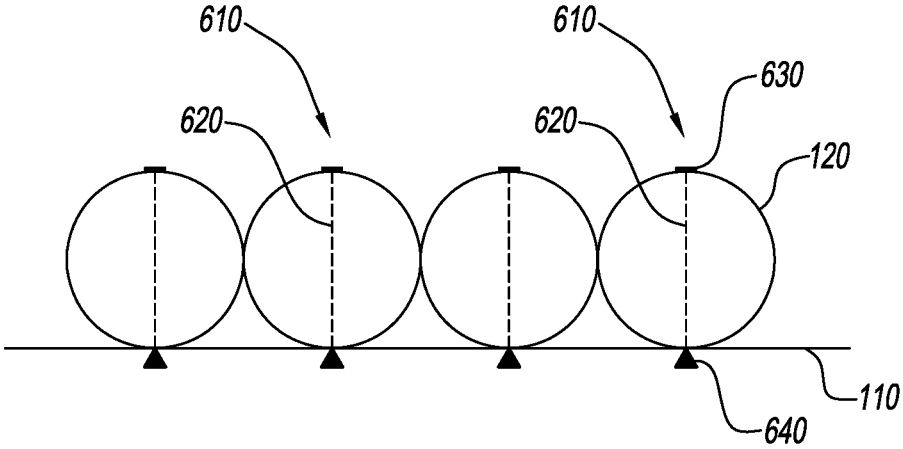
FIG. 6 shows an alternative attachment mechanism for attaching compressible impact-dissipating elements to a base.

FIG. 6 shows alternative attachment elements 610 for the spherical compressible impact-dissipating elements 120 shown in FIG. 1. In FIG. 6, attachment elements 610 comprise a substantially linear portion 620 passing through a diameter of compressible impact-dissipating elements 120. On one end of substantially linear portion 620 is an anchor 630 disposed at the end of substantially linear portion 620 adjacent an outside surface of compressible impact-dissipating elements 120. On another end of substantially linear portion 620 is a lock 640 that is disposed on a side of base 110 opposite compressible impact-dissipating elements 120. In combination, substantially linear portion 620, anchor 630 and lock 640 serve to hold compressible impact-dissipating elements 120 against an inner surface of base 110, but allow for movement of compressible impact-dissipating elements 120 in all directions.

Figure 7A:
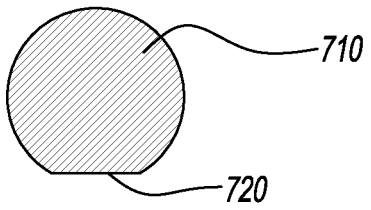
FIGS. 7A and 7B show compressible impact-dissipating elements having a flat region for adhering to a base.
Figure 7B:
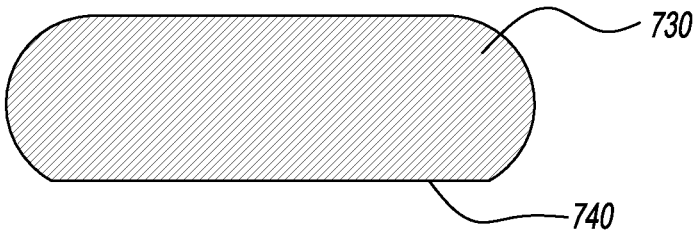
Figure 7C:
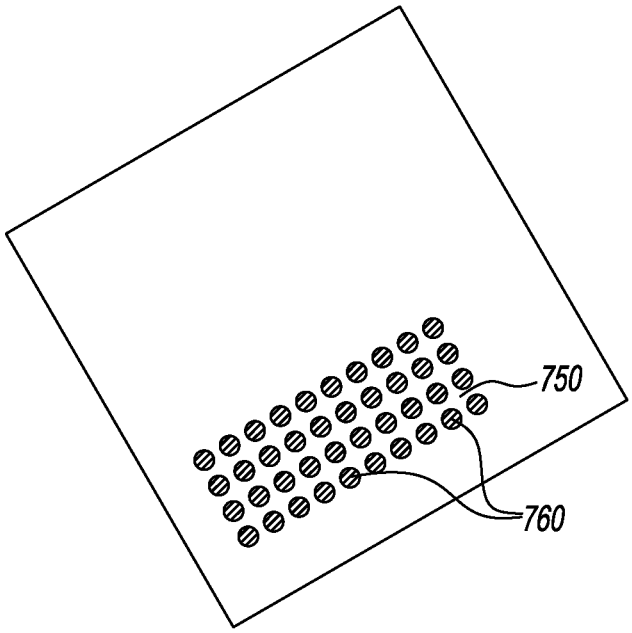
FIGS. 7C and 7D show corresponding bases having location indicators for the placement of compressible impact-dissipating elements of FIGS. 7A and 7B respectively.
Figure 7D:
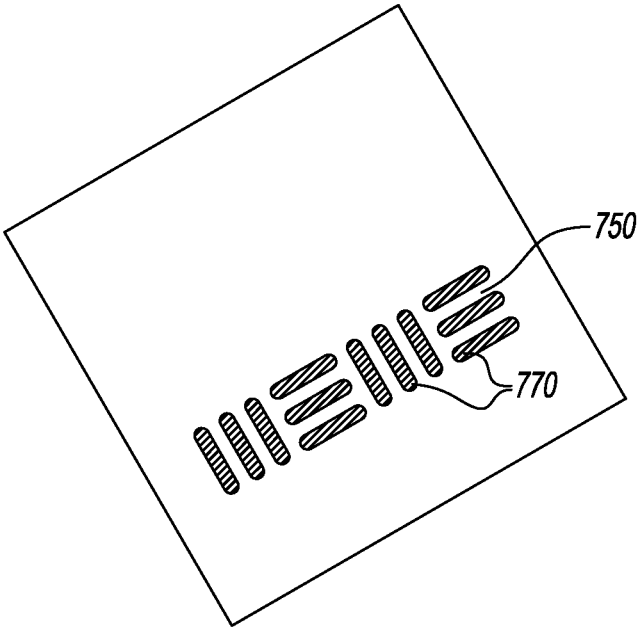

FIGS. 7A and 7B show compressible impact-dissipating elements 710, 730 having flat regions 720, 740, respectively, that provide another alternative attachment mechanism for compressible impact-dissipating elements 710, 730. As will be appreciated, the use of flat regions 720, 740 provides an area for attachment of compressible impact-dissipating elements 710, 730 by, for example, an adhesive. Such an attachment area allows for potentially less expensive and faster attachment of compressible impact-dissipating elements to a base, such as base 110. FIGS. 7C and 7D show a base 750 having attachment indicators 760, 770 for flat regions 720, 740, respectively. It will be understood that attachment indicators 760, 770 may or may not actually be visible on base 750, but may only show placement of compressible impact-dissipating elements 710, 730 such as by computer-aided fabrication. On the other hand, attachment indicators 760, 770 may be "etched" and be visible on base 750 and, if "etched", i.e., having a roughened surface may provide a better surface area for placement and attachment of compressible impact-dissipating elements 710, 730. As will be understood by those of skill in the art of helmet design and manufacture, base 750 will have some degree of curvature to match the interior curvature of a helmet. For this reason, it will be appreciated that the placement of attachment indicators 760, 770 will be modified to account for this curvature so that compressible impact-dissipating elements 710, 730 do not substantially compress against one another due to that curvature when in place on base 750 having some curvature to match the interior curvature of a helmet.

In the above detailed description, the specific embodiments of this disclosure have been described in connection with some of its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above but, rather, the disclosure includes all alternatives, modifications, and equivalents falling within the scope of the appended claims. Various modifications and variations of this disclosure will be obvious to a those skilled in the art and it is to be understood that such modifications and variations are to be included within the purview of this application and the spirit and scope of the claims.

All of the patents, patent publications and other references referred to above are incorporated herein by reference for all that they contain as if the contents thereof have been fully set forth verbatim herein.

What is claimed is:

1. An apparatus for providing impact performance to a helmet, the apparatus comprising:

a base having a first surface configured to be proximal to an interior surface of the helmet, a second surface configured to be proximal a helmet wearer's head, and a plurality of attachment sites;

a plurality of compressible impact-dissipating elements attached to the attachment sites using fiber attachment mechanisms having a length sufficient to pass through and attach a compressible impact-dissipating element to the base, wherein the first surface of the base is further configured to attach to the interior surface of the helmet, wherein the attachment mechanisms and the plurality of compressible impact-dissipating elements allow movement of the plurality of compressible impact-dissipating elements in a plurality of directions, wherein the plurality of compressible impact-dissipating elements are sized and configured to contact a wearer's head when the helmet is worn, and wherein each compressible impact-dissipating element is completely disposed on the second surface of the base; and at least one attachment element for removably attaching the base to the interior surface of the helmet.

2. The apparatus according to claim 1, wherein the shape of each of the plurality of compressible impact-dissipating elements is selected from the group consisting of spherical, tubular, oblong, football and any combinations of the foregoing.

3. The apparatus according to claim 1, wherein each of the plurality of compressible impact-dissipating elements is compressible at least 50% of a short axis thereof.

4. The apparatus according to claim 1, wherein each of the plurality of compressible impact-dissipating elements has a short axis of from ½ inch to 1 inch.

5. The apparatus according to claim 1, wherein each of the plurality of compressible impact-dissipating elements contacts each adjacent compressible impact-dissipating element when disposed on the base.

6. The apparatus according to claim 1, wherein each of the compressible impact-dissipating elements is attached to the base to allow movement thereof along any combination of X, Y and Z directions.

7. The apparatus according to claim 1, wherein the plurality of compressible impact-dissipating elements is sized and configured to be minimally compressed when the helmet is placed on a wearer's head.

8. The apparatus according to claim 1, wherein the base comprises two shells, one for the left inside area of the helmet and one for the right inside area of the helmet.

9. The apparatus according to claim 1, wherein the base is removably attached to the interior surface of the helmet using an attachment element selected from the group consisting of hook and loop inter-connectors, snaps, hot melt glues, zippers and any combinations of the foregoing.

10. A method for providing impact performance to a helmet, the method comprising:

providing a plurality of compressible impact-dissipating elements;

providing a base having a plurality of attachment sites configured to accept the plurality of compressible impact-dissipating elements disposed thereon using fiber attachment mechanisms having a length sufficient to pass through and attach a compressible impact-dissipating element to the base, wherein the base is further configured to be attached to an interior surface of the helmet;

attaching the plurality of compressible impact-dissipating elements to the base, wherein the plurality of compressible impact-dissipating elements is attached to the base to allow movement of the plurality of compressible impact-dissipating elements in a plurality of directions, and wherein the compressible impact-dissipating elements are sized and configured to contact a wearer's head when the helmet is worn; and removably attaching the base to the inside of the helmet with the compressible impact-dissipating elements disposed away from an interior surface of the helmet.

11. The method according to claim 10, wherein the shape of each of the plurality of compressible impact-dissipating elements is selected from the group consisting of spherical, tubular, oblong, football and any combinations of the foregoing.

12. The method according to claim 10, wherein each of the plurality of compressible impact-dissipating elements is compressible at least 50% of a short axis thereof.

13. The method according to claim 10, wherein each of the plurality of compressible impact-dissipating elements has a short axis of from ½ inch to 1 inch.

14. The method according to claim 10, wherein each of the plurality of compressible impact-dissipating elements contacts each adjacent compressible impact-dissipating element when disposed on the base.

15. The method according to claim 10, wherein each of the compressible impact-dissipating elements is attached to the base to allow movement thereof along any combination of X, Y and Z directions.

16. The method according to claim 10, wherein the plurality of compressible impact-dissipating elements is sized and configured to be minimally compressed when the helmet is placed on a wearer's head.

17. The method according to claim 10, wherein the base comprises two shells, one for the left inside area of the helmet and one for the right inside area of the helmet.

18. The method according to claim 10, wherein the base is removably attached to the interior surface of the helmet using an attachment element selected from the group consisting of hook and loop interconnectors, snaps, hot melt glues, zippers and any combinations of the foregoing.

* * * * *